US006032956A

United States Patent [19]

Boguczz

[11] Patent Number: 6,032,956

[45] Date of Patent: Mar. 7, 2000

[54] BOARD GAME

[76] Inventor: John Boguczz, 171 Powerville Rd., Boonton, N.J. 07005

[21] Appl. No.: 09/263,333

[22] Filed: Mar. 5, 1999

[51] Int. Cl.[7] ..... A63F 3/00

[52] U.S. Cl. ..... 273/236; 273/287; 273/242; 273/258

[58] Field of Search ..... 273/236, 248, 273/243, 258, 288, 287

[56] References Cited

U.S. PATENT DOCUMENTS

| | | |
|---|---|---|
| 1,787,521 | 1/1931 | Harrington, Jr. . |
| 3,638,947 | 2/1972 | Hardesty . |
| 4,119,321 | 10/1978 | Creel . |
| 4,364,568 | 12/1982 | Tracy . |
| 4,364,951 | 12/1982 | Tracy . |
| 4,667,965 | 5/1987 | Helms, Jr. . |
| 4,700,951 | 10/1987 | Lachenmeier . |
| 4,940,240 | 7/1990 | Braley . |
| 5,007,648 | 4/1991 | Polan . |
| 5,403,012 | 4/1995 | Stein . |
| 5,657,989 | 8/1997 | Acoba . |

*Primary Examiner*—Jeanette Chapman
*Assistant Examiner*—V. K Mendiratta
*Attorney, Agent, or Firm*—Donald S. Cohen

[57] ABSTRACT

A board game includes a board having on a surface thereof a pattern of squares. The squares are arranged in parallel rows extending between the sides of the board and extending substantially parallel to and between the ends of the board. Several of the rows of squares intermediate the ends of the board contain fewer squares than the other rows of squares. The row of squares at each end of the board is of a first color, the next two rows of squares are of a second color, the intermediate rows of squares are of the second color, and all of the other rows of squares are of a third color. The game includes a plurality of playing pieces with half of the pieces having a first cross-sectional shape and the other half having a second cross-sectional shape. The playing pieces of each cross-sectional shape have some pieces which are longer than the other pieces. The playing pieces are of different colors with one longer piece and one shorter pieces being of the same color. The game also includes a plurality of playing cards which are of different colors corresponding to the colors of the playing pieces. The cards have indicia on a face thereof which correspond to the shape and size of the playing pieces.

14 Claims, 1 Drawing Sheet

BOARD GAME

FIELD OF THE INVENTION

The present invention relates to a board game, and, more particularly, to a board game having a plurality of playing pieces which are moved across a board for one end to the other based on the guesses or intuition of the players.

BACKGROUND OF THE INVENTION

There are many board games in which playing pieces are moved across, along or around a board. In many of these games, the playing pieces are moved according to either indicia on dice that are thrown or indicia on a card that is picked. In such games, the movement of the playing pieces is dependent solely on chance or the luck of the throw of the dice or the pick of a card. However, it would be desirable to have a game where movement of the playing pieces is dependent on the judgement or intuition of the players of the game. This would make the game more interesting since the player can attempt to out guess his/her opponent and develop an unpredictable strategy for advancing his/her playing pieces while the opponent uses his/her intuition to stop the player's movement of the playing pieces and regain control to move his/her playing pieces and thereby control the outcome of the game.

SUMMARY OF THE INVENTION

A board game includes a board divided into a plurality of square which are arranged in a plurality of rows across the board, the rows at each end of the board are of a first color, the rows of squares next to the end rows are of a second color, some of the rows of squares intermediate the ends of the board are of the second color, and all of the other rows of squares are of a third color. The game also includes a plurality of playing pieces of two different shapes. The playing pieces of each shape are of two different sizes and a plurality of different colors. Also included are a plurality of playing cards having indicia thereon. The playing cards are of different colors corresponding to the colors of the playing pieces. The indicia on the playing cards are of different shapes corresponding to the shapes of the playing pieces.

DETAILED DESCRIPTION OF PREFERRED EMBODIMENT

Figure 1:
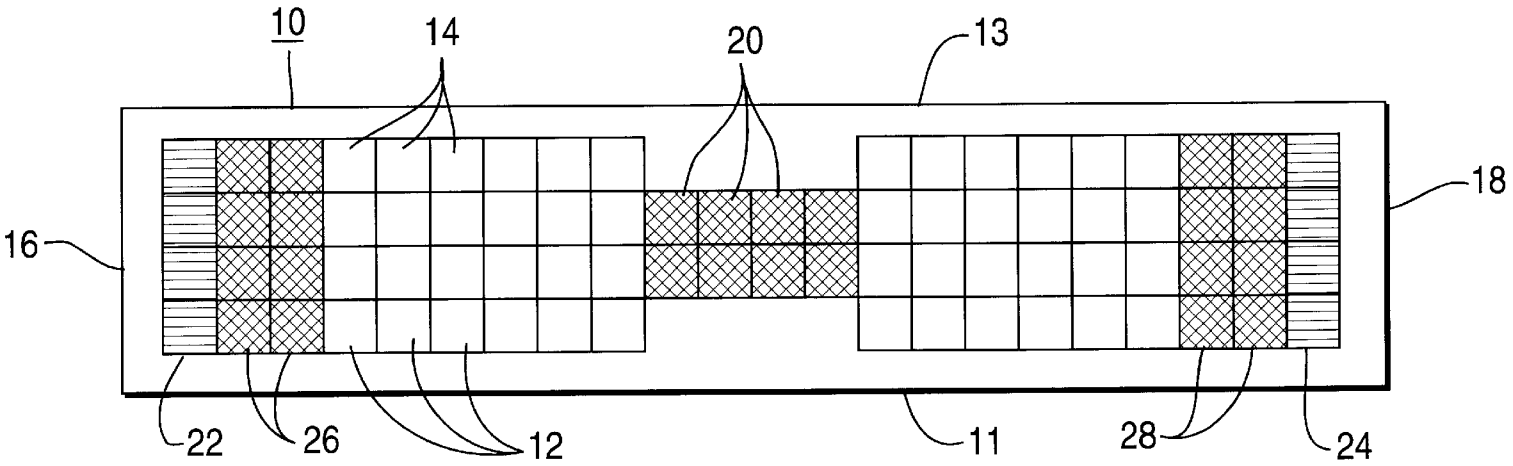
FIG. 1 is a top view of the playing board of the game of the present invention.

Referring initially to FIG. 1, the board game of the present invention comprises a board 10 having on a surface thereof a pattern of a plurality of squares 12. The squares 12 are arranged in a plurality of parallel rows 14 extending from one end 16 of the board 10 to the opposite end 18 thereof, and between the spaced sides 11 and 13 of the board 10. As shown, there are twenty two rows 14 of the squares 12. All of the rows 14 of squares 12 contain the same number of squares 12, four as shown, except the four rows 20 intermediate the ends 16 and 18 of the board 10. The four intermediate rows 20 contain only two squares 12 each. The row 22 of squares 12 at the end 16 of the board 10 is of a first color, and the row 24 of squares 12 at the end 18 of the board 10 is also of the first color. The next two rows 26 of squares 12 adjacent the end row 22 are of a second color, and the next two rows 28 of squares 12 adjacent the end row 24 are of the same second color. The four intermediate rows 20 of squares 12 are also of the second color. All of the remaining squares 12 are of a third color. Although any colors can be used, an example is blue for the first color, tan for the second color and white for the third color.

Figure 2:
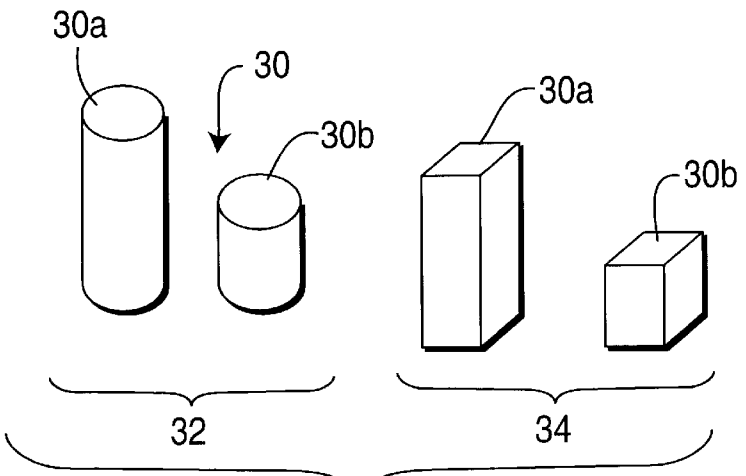
FIG. 2 is a perspective view of some of the playing pieces of the game of the present invention.

The game includes a plurality of playing pieces 30, examples of which are shown in FIG. 2. For the game board of the size shown in FIG. 1, twelve playing pieces 30 are used. The playing pieces 30 are divided into two groups 32 and 34, each group having six playing pieces 30. The playing pieces 30 of each of the groups 32 and 34 has a different cross-sectional shape. For example, as shown in FIG. 2, one group 32 has a circular cross-section and the other group 34 has a square cross-section. However, any desired cross-section can be used for each of the groups. The playing pieces 30 of each group 32 and 34 has some pieces 30*a* which are longer than the other pieces 30*b*. Thus, in each group 32 and 34 there are three pieces 30*a* which are longer than the other three pieces 30*b*. Also, in each of the groups 32 and 34, there are one long piece 30*a* and one short pieces 30*b* of one color, another long pieces 30*a* and another short pieces 30*b* of a second color and the third long pieces 30*a* and third short pieces of a third color. The color of the pieces 30 in each group 32 and 34 are different from each other. For example, in the group 32 of pieces 30 having a circular cross-section, one pair of long and short pieces 30*a* and 30*b* may be red in color, another pair may be blue and the third pair may be green. In the group 34 of pieces 30 having a square cross-section, one pair of long and short pieces 30*a* and 30*b* may be silver in color, the second pair may be gold and the third pair may be black. However, any other desired colors may be used.

Figure 3:
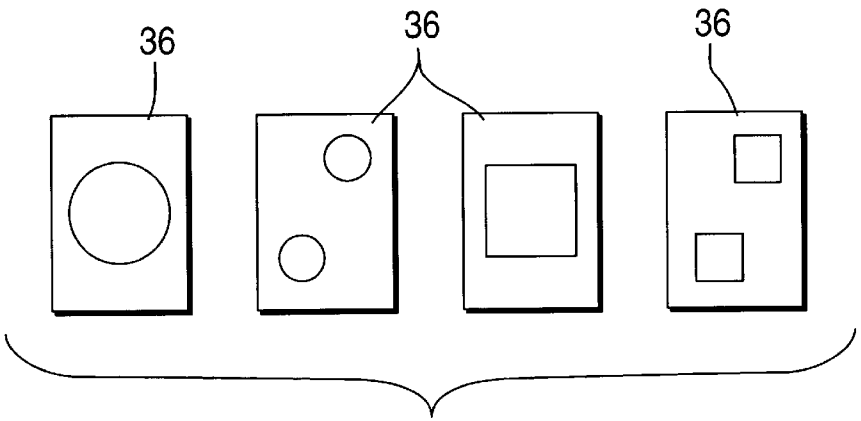
FIG. 3 is a top view of several of the playing cards used in the game of the present invention showing the different indicia thereon.

The game also includes a plurality of playing cards 36, the number of which is equal to the number of playing pieces 30 used. Thus, for the game described above, there are twelve playing cards 36. An example of some of the playing cards 36 are shown in FIG. 3. The playing cards 36 are of different colors corresponding to the colors of the playing pieces 30. Thus, for the example of the colors of the playing pieces 30 described above, there are two red cards 36, two blue cards 36, two green cards 36, two silver cards 36, two gold cards 36 and two black cards 36. Each of the cards 36 has an indicia on a surface thereof corresponding to the cross-sectional shape and length of a corresponding playing pieces 36. For example, the red playing cards 36, which correspond to the red playing pieces 30 which have a circular cross-section, each has a circle thereon. One of the red playing cards 36 has a large circle to correspond to the longer red playing piece 30*a* and the other red playing card 36 has two small circles thereon corresponding to the short red playing piece 30*b*. Each of the blue and green cards 36 like wise have either a large or small circle thereon. Each of the silver, gold and black playing cards 36 has a square thereon to correspond to the silver, gold and black playing pieces 30 which have a square cross-section. One of each of the silver, gold and black playing cards 36 has a large square thereon to correspond to the longer silver, gold or black playing piece 30*a*, and the other of the silver, gold and black playing cards 36 has two small squares thereon to correspond to the short silver, gold and black playing pieces 30*b*.

To play the game of the present invention, two players each select the playing pieces of the cross-section he/she would like to use. Thus, one player selects the playing pieces of round cross-section and the other player takes the playing pieces of square cross-section. Also, each player takes the cards which correspond to the playing pieces selected. Each of the players places his/her playing pieces along the first row of the third color from the players end of the board 10. Thus, if the third color is white, each of the players places the three longer playing pieces 30*a* on separate squares 12 of the third row 14 of squares 12 from his/her end of the board 10, and the shorter playing pieces 30*b* on separate squares 12 of the fourth row 14 of squares 12 from his/her end of the board 10. Each of the shorter playing pieces 30*b* is placed in front of the corresponding color of the longer playing piece 30*a*.

The first player to start the play of the game is selected by toss of a coin. The winner of the coin flip selects a card from his/her set of cards and holds it in front of the other cards in their hand so that the other player cannot see the color of or indicia on the selected card. This card represents the playing piece that he/she would like to move. The other player then says out loud what color and size piece they think has been selected. For example, the other person may say "big blue", "little silver", etc. The following guide lines are then used for this initial guess and for all of the other guesses made during the game:

If the second player does not guess the color of the playing card selected by the first player, the first player can then move the selected playing piece one space in any direction, including diagonally, and can jump over other playing pieces, as many as possible, in a straight line. The first player then selects a second card and the second person then tries to guess the indicia on the second card.

If the second player guesses the correct color but not the correct size, then the turn is over and the playing piece selected is not moved,. The roles are now reversed, with the person doing the guessing now becoming the person who selects a card.

If the second person correctly guesses the color and size shown on the selected card, that corresponding playing piece is moved straight back one space, jumping over other playing pieces if necessary, and the turn is over. Again the roles are reversed, with the person doing the guessing now becoming the person who selects a card.

If the right color and size are guessed and the selected piece is on a square of the intermediate rows 20, which may be tan in color, then the selected piece is moved straight back three spaces, jumping over other pieces if necessary, and the turn is over. If the selected piece is on a tan space 12 at the opponents end of the board, than it is moved straight back three spaces, jumping over other pieces if necessary, and the turn is over. If there are no available spaces to move the selected playing pieces back because the playing pieces is at or near the end of the playing board, then that playing piece is removed from play and lost for the rest of the game. The first person to advance one playing piece across the game board to one of the opponents end row of squares 12, which are blue in color, wins the game.

Thus, there is provided by the present invention a board game in which movement of playing pieces is achieved by a guess or intuition of the players. Each player has the opportunity to select a desired playing card to choose which playing piece he/she wants to move, and the other player has the opportunity to guess the color and indicia on the card to achieve a movement of the playing pieces either forward or backward. Thus, the play is not merely a mater of chance but is based on one player attempting to out guess his/her opponent and developing an unpredictable strategy for moving his/her playing pieces while the opponent uses his/her intuition to stop the one player's movement of his/her playing pieces and regain control to move his/her playing pieces so as to make the play of the game more interesting.

What is claimed is:

1. A game comprising:

a board having spaced sides and opposed spaced ends;

a plurality of squares on a surface of said board, said squares being arranged in parallel rows extending across the board between the spaced sides of the board, the row of squares at each end of the board being of a first color, the row of squares next to the end rows being of a second color, a few of the rows of squares intermediate the ends of the board being of said second color, and all of the other squares being of a third color;

a plurality of playing pieces of two different cross-sectional shapes, the playing pieces of each cross-sectional shape being of three two different sizes and three different colors; and a plurality of playing cards having indicia on a face thereof, the playing cards being of different colors corresponding to the colors of the playing pieces, and the indicia on the playing cards being of a shape corresponding to the cross-sectional shapes of the playing pieces.

2. The game of claim 1 wherein the intermediate rows of the squares on the board contain fewer squares than the other rows of squares.

3. The game of claim 2 in which each of the intermediate rows of squares have two squares in a row, and all of the other rows have four squares in each row.

4. The game of claim 3 in which there are twenty-two rows of squares arranged in parallel from one end of the board to the other and four intermediate rows of squares.

5. The game of claim 1 wherein the two rows of squares next to each end row of squares is of the second color.

6. The game of claim 1 in which there are six playing pieces of each cross-sectional shape with three of the playing pieces of each cross-sectional shape being longer than the other three playing pieces of the same cross-sectional shape.

7. The game of claim 6 in which the playing pieces of each cross-sectional shape are of three different colors with one large pieces and one small piece of each cross-sectional shape being of the same color.

8. The game of claim 7 in which the indicia on each playing card corresponds to both the cross-sectional shape and the size of a different playing pieces.

9. A board game comprising:

a board having a surface, a pair of spaced sides and spaced opposed ends;

a pattern of a plurality of squares on said surface of the board, said squares being arranged in parallel rows which are substantially parallel to the ends of the board and extend between the sides of the board, the row of squares at each end of the board being of a first color, the next two rows of squares at each end of the board being of a second color, four of the rows of squares intermediate the ends of the board being of said second color, and all of the other squares being of a third color;

twelve playing pieces, six of said playing pieces being of a first cross-sectional shape and the other six playing pieces being of a second cross-sectional shape, three of the playing pieces of the first cross-sectional shape being longer than the other three playing pieces of the first cross-sectional shape, and three of the playing pieces of the second cross-sectional shape being longer than the other three playing pieces of the second cross-sectional shape; and twelve playing cards having indicia on a face thereof, the indicia on each of the playing cards corresponding to the shape and size of a different playing piece.

10. The board game of claim 9 in which the playing pieces of the first cross-sectional shape are of three different colors and the playing pieces of the second cross-sectional shape being of three different colors different from the colors of the playing pieces of the first cross-sectional shape.

11. The board game of claim 10 in which a longer playing piece and a shorter playing piece of each cross-sectional shape are of the same color.

12. The board game of claim 11 in which the playing cards are of different colors corresponding to the colors of the playing pieces.

13. The board game of claim 12 in which there are twenty-two rows of square extending from one end of the board to the other and four intermediate rows of the squares.

14. The board game of claim 13 in which each of the intermediate rows of squares has two squares per row and each of the other rows of squares has four squares per row.

* * * * *